US008950426B2

(12) United States Patent
Yewdall et al.

(10) Patent No.: US 8,950,426 B2
(45) Date of Patent: Feb. 10, 2015

(54) WATER DISCHARGE DEVICE

(76) Inventors: Gary Yewdall, Geelong (AU); Graham Pickering, Geelong (AU)

( * ) Notice: Subject to any disclaimer, the term of this patent is extended or adjusted under 35 U.S.C. 154(b) by 891 days.

(21) Appl. No.: 13/131,300

(22) PCT Filed: Nov. 26, 2009

(86) PCT No.: PCT/AU2009/001542

§ 371 (c)(1),
(2), (4) Date: May 26, 2011

(87) PCT Pub. No.: WO2010/060142

PCT Pub. Date: Jun. 3, 2010

(65) Prior Publication Data

US 2011/0233295 A1 Sep. 29, 2011

(30) Foreign Application Priority Data

Nov. 26, 2008 (AU) ..... 2008906123

(51) Int. Cl.
*F16K 49/00* (2006.01)
*E03C 1/044* (2006.01)
*E03C 1/05* (2006.01)

(52) U.S. Cl.
CPC ..... *E03C 1/044* (2013.01); *E03C 1/055* (2013.01)
USPC ..... 137/341; 137/801; 4/623; 4/678

(58) Field of Classification Search
USPC ..... 137/334, 341, 801; 4/623, 678
See application file for complete search history.

(56) References Cited

U.S. PATENT DOCUMENTS

| | | | | |
|---|---|---|---|---|
| 3,915,193 | A | 10/1975 | Rutt | |
| 4,894,874 | A * | 1/1990 | Wilson | 4/623 |
| 5,099,895 | A | 3/1992 | Loeliger | |
| 5,918,855 | A * | 7/1999 | Hamanaka et al. | 251/129.04 |
| 8,175,446 | B2 * | 5/2012 | Russegger et al. | 392/473 |
| 2001/0011390 | A1 * | 8/2001 | Humpert et al. | 4/623 |
| 2006/0144443 | A1 * | 7/2006 | Yewdall et al. | 137/341 |

FOREIGN PATENT DOCUMENTS

| | | | |
|---|---|---|---|
| FR | 2835033 | A1 | 7/2003 |
| JP | 2001140305 | A | 5/2001 |

OTHER PUBLICATIONS

International Search Report for PCT/AU2009/001542, Completed by the Australian Patent Office on Feb. 17, 2010, 4 Pages.

* cited by examiner

*Primary Examiner* — Craig Schneider
*Assistant Examiner* — Ian Paquette
(74) *Attorney, Agent, or Firm* — Brooks Kushman P.C.

(57) ABSTRACT

There is disclosed a water discharge device that has a water flow path that extends from an inlet through an outlet chamber to an outlet spout; a valve assembly for opening and closing the water flow path; a heating element for heating the outlet chamber and spout to evaporate moisture on internal surfaces of the outlet chamber and spout when the flow path is closed by the valve assembly, the heating element being remote from the flow path; and a controller for controlling operation of the valve assembly and the heating element, the controller including a switch that is operated directly or indirectly by a user to control the opening of the water flow path.

15 Claims, 9 Drawing Sheets

WATER DISCHARGE DEVICE

CROSS-REFERENCE TO RELATED APPLICATION

This application is the U.S. national phase of PCT Appin. No. PCT/AU2009/001542 filed Nov. 26, 2009, which claims priority to Australian application 2008906123 filed Nov. 26, 2009, the disclosures of which are incorporated in their entirety by reference herein.

FIELD OF THE INVENTION

The present invention relates to a water discharge device of the type that is suitable for use with a sink as a receptacle for water out flowing from the device.

BACKGROUND

Hand washing sinks and basins are used in many different environments. The water discharge device used in connection with the sink/basin is typically selected to suit the environment in which the sink/basin is located. For instance, in medical applications in which hygiene is of importance it is desirable to minimize the transfer and growth of bacterial colonies within the water delivery system components.

A variety of water discharge devices have been designed to minimize cross contamination by removing the need for direct hand contact to operate the necessary valves. This type of water discharge device is often referred to as a "hands-free tap". Examples of hands-free taps include arm-operated faucet levers, and foot operated valves. Increasingly, sensor actuated valves are being used in water discharge devices so that users need only place their hands near the sensor, rather than physically contacting any components of the device.

Typical industries where minimizing cross contamination is desirable include:

food preparation or food manufacturing;

hospital wards;

wash or scrub room that leads into the operating theatre;

doctor or dentist rooms;

change locks for clean rooms; and medical rooms at sporting clubs and schools.

However, cross contamination can still occur using hands-free taps by users touching the tap fluid outlet chamber, or by airborne contamination entering the moist or wet tap fluid outlet chamber which is an ideal site for harbouring and growth of contamination.

In current technology, residual moisture and stagnant water remains within the spouts of water delivery devices between uses. Studies show that this stagnant water or moisture is readily contaminated by physical contact or by airborne contaminants entering the tap outlet spout. The stagnant water can form a stable "biofilm" on the internal lining surfaces of the spout within which pathogens and opportunistic bacteria will grow. Bacteria in the biofilm can slough off contamination randomly, contaminating discharged water, while continually replenishing itself.

Studies have shown that the "still standing" tap water in hands free taps can provide nearly ideal growth conditions for *Pseudomonas aeruginosa*. This is a significant problem for Intensive Care Units and burns centres. Contaminated spouts have also been shown to cause cross-transmission of other dangerous organisms, such as *Legionella* ssp.

There is a need for water discharge devices that can reduce the microbial contamination of discharged water.

SUMMARY OF THE INVENTION

The present invention provides a water discharge device comprising:

a water flow path that extends from an inlet through an outlet chamber to an outlet spout;

a valve assembly for opening and closing the water flow path;

a heating element for heating the outlet chamber and spout to evaporate moisture on internal surfaces of the outlet chamber and spout when the flow path is closed by the valve assembly, the heating element being remote from the flow path; and a controller for controlling operation of the valve assembly and the heating element, the controller including a switch that is operated directly or indirectly by a user to control the opening of the water flow path.

The present invention can also provide a water discharge device comprising:

a water flow path that extends from an inlet an outlet;

a valve assembly for opening and closing the water flow path between the inlet and outlet;

a heating element that is remote from the flow path, the heating element being arranged to heat the device to evaporate moisture on internal surfaces surrounding the flow path between the valve assembly and the outlet when the flow path is closed by the valve assembly; and a controller for controlling operation of the valve assembly, the controller including a switch that is operated directly or indirectly by a user to control opening and closing of the water flow path.

The water discharge device can further comprise a sensor that is in electrical communication with the switch, wherein the sensor can sense when a person's hands are within a certain range and cause the controller to open and close the water flow path.

In certain embodiments, the sensor is an infra-red sensor.

In certain embodiments, the assembly includes a valve actuator; a valve body that defines a valve seat; and a valve plunger that co-operates with the valve seat and is movable by the valve actuator to selectively open and close the flow path.

The valve body can have an inlet chamber and an outlet chamber that each form part of the flow path, wherein the valve seat and valve plunger are positioned between the inlet and outlet chambers.

Preferably, the valve body includes an aperture within which the heating element is disposed, the aperture being beside the outlet chamber, to maximise the conductive heat transfer to the outlet chamber and outlet spout.

The valve body can include a void formed between the aperture and the inlet chamber for minimizing conductive heat transfer from the heating element to the inlet chamber.

The void can be in the form of an annular recess that extends around the inlet chamber.

The water discharge device can further comprise a base for mounting the device to a bench top and a casing that supports the valve body above the base. Preferably, the base defines a throughway and the casing is hollow such that electrical wires and an inlet riser tube can pass through the base and the casing.

In certain embodiments, the assembly is located at the top of the flow path so that water downstream of the valve assembly drains from the flow path when the valve assembly is closed.

The present invention also provides a method of operating a water discharge device as described above, the method comprising:

opening the valve for a first period of time to allow water to flow through the flow path, and operating the heating element for a second period of time, wherein the second period of time concludes after the first period of time.

In certain embodiments, the first and second periods of time overlap.

In some embodiments, wherein the first and second periods of time commence concurrently.

Preferably, the second period of time is a predetermined period of time.

In some embodiments, the first period of time is a predetermined length of time.

The present invention also provides a water discharge device comprising:

a water flow path extending from an inlet to an outlet spout;

a valve assembly for opening and closing the water flow path, the assembly being located at a top of the flow path so that, when the flow path is closed by the valve assembly, water downstream of the valve assembly drains from the flow path; and a controller for controlling operation of the valve assembly, the controller including a switch that is operated directly or indirectly by a user to control the opening of the water flow path.

BRIEF DESCRIPTION OF THE DRAWINGS

In order that the invention may be more easily understood, embodiments will now be described, by way of example only, with reference to the accompanying drawings, in which.

DETAILED DESCRIPTION

Figure 1:
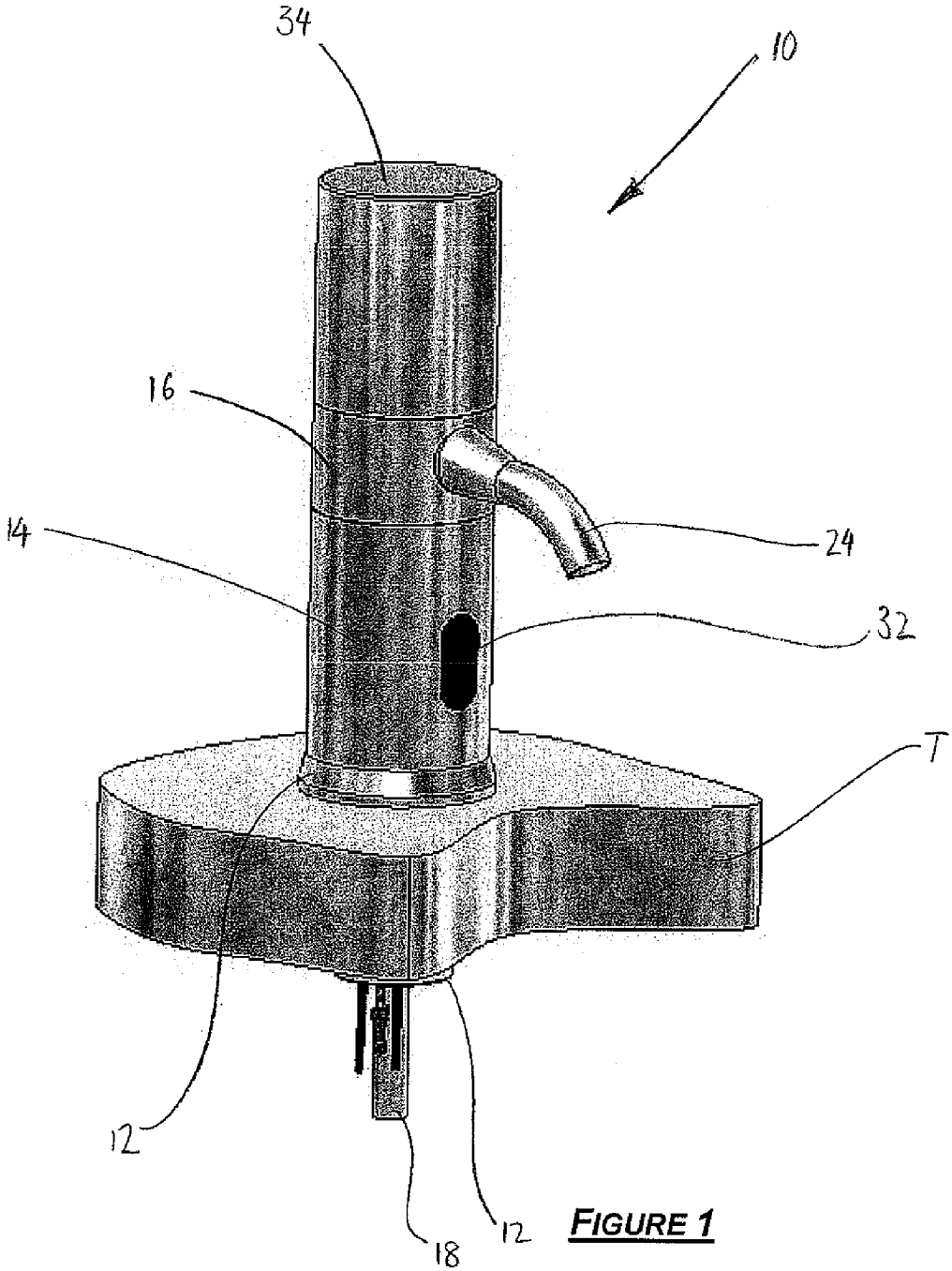
FIG. 1: is a perspective view of a water discharge device according to a first embodiment of the present invention.

FIGS. 1 to 5 show a water discharge device 10 according to a first embodiment of the present invention. The discharge device 10 can be mounted in a through hole (not shown) of a bench top T, which is beside a sink/basin (also not shown).

The discharge device 10 defines a water flow path that extends from an inlet 18 to an outlet. In this particular embodiment, the outlet includes an outlet chamber 22 and an outlet spout 24. The discharge device 10 includes a valve assembly for opening and closing the water flow path. A heating element 36 is provided for heating the outlet when the flow path is closed by the valve assembly. Thus, the heating element 36 can heat the outlet chamber 22 and spout 24 to evaporate moisture from the internal surfaces between the valve assembly and the outlet.

The heating element 36 is remote from the flow path, so that the heating element 36 does not heat fluid within the flow path directly. Instead, the heating element 36 heats the discharge device 10 beside the flow path and heat is conducted to the internal surfaces that define the flow path.

An electronic controller 44 is provided that controls operation of the valve assembly and the heating element 36. The electronic controller 44 includes a switch 46 that is operated directly or indirectly by a user to control the opening of the water flow path.

Figure 2:
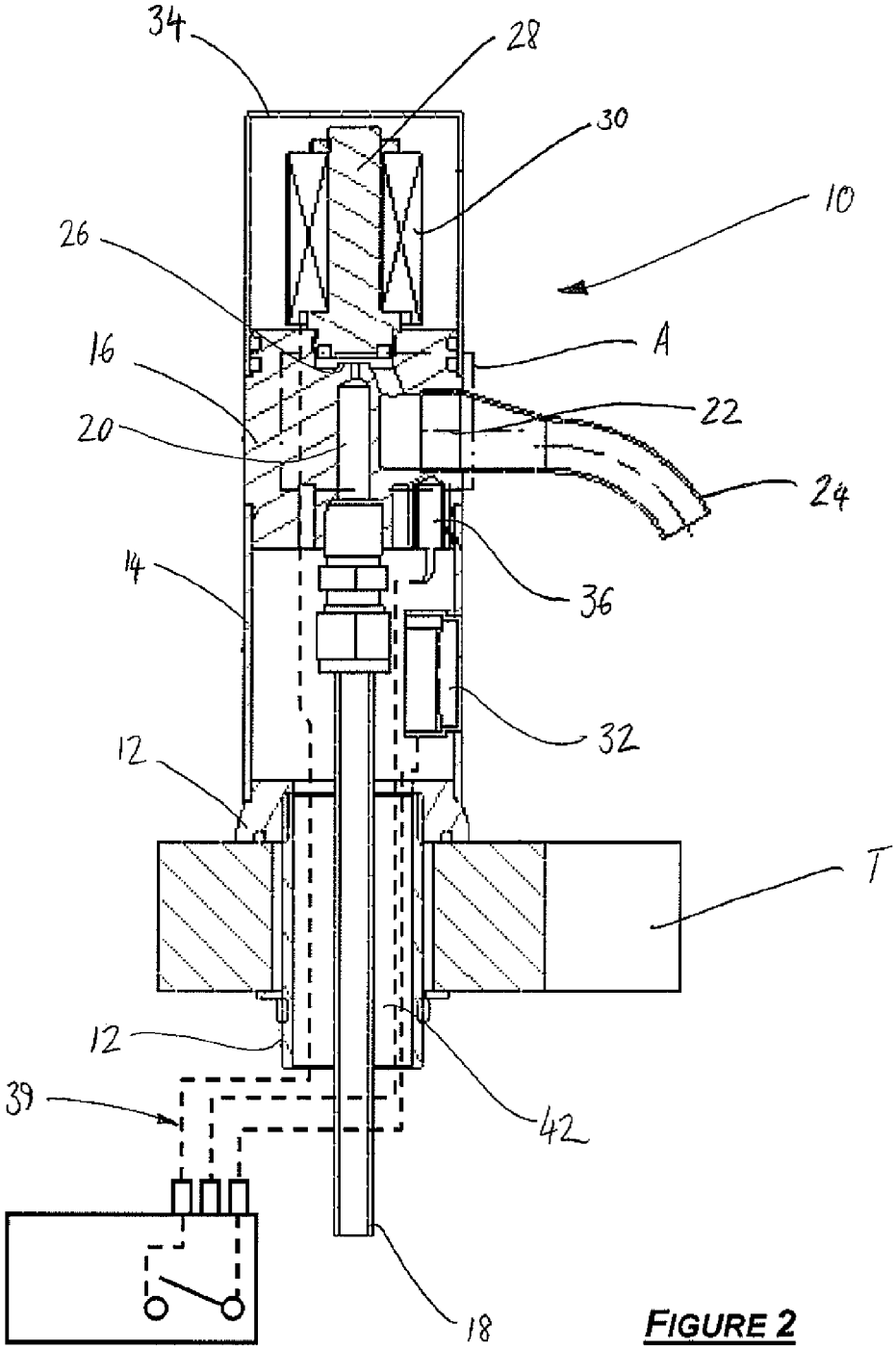
FIG. 2: is a vertical cross section view of the water discharge device of FIG. 1.
Figure 3:
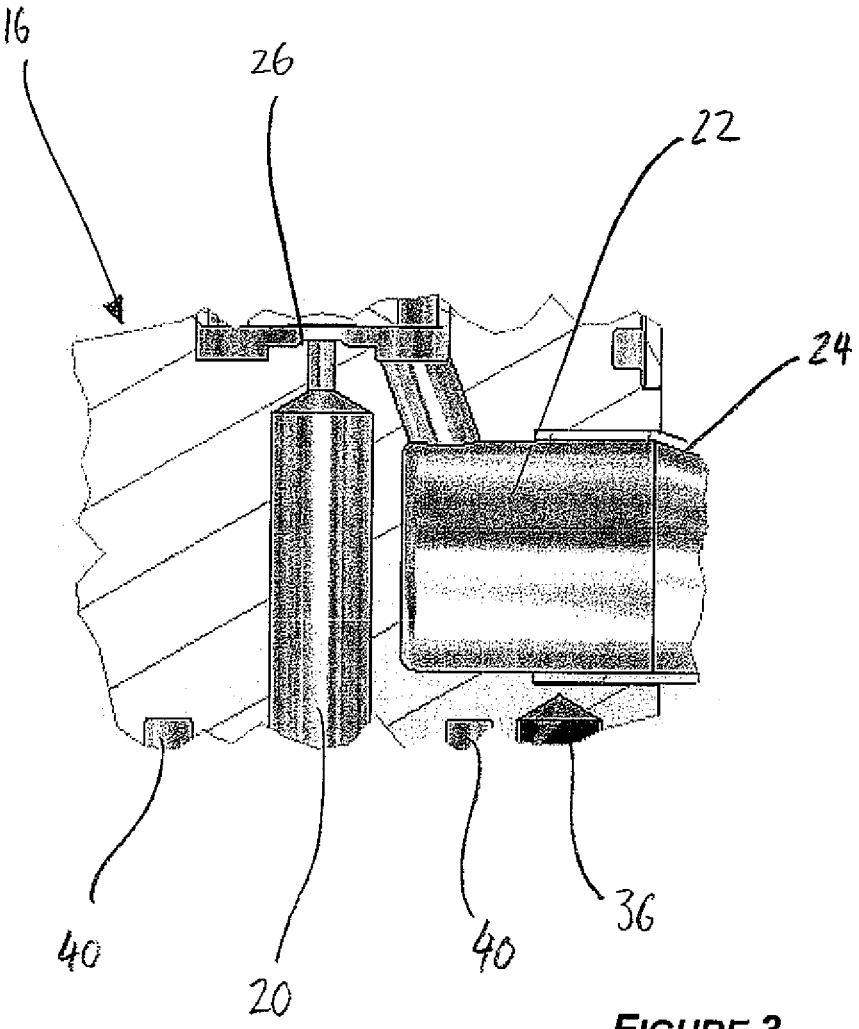
FIG. 3: is an enlarged view of the region marked A in FIG. 2.

As shown most clearly in FIG. 2, the discharge device 10 has a hollow base 12 that mounts and secures the discharge device 10 to the bench top T. The valve assembly includes a valve body 16, which is supported above the base 12 by a hollow casing 14. The casing 14 spaces the valve body 16 from the base 12. The base 12 and casing 14 together define a throughway through which an inlet riser tube 18 can pass from below the bench top T to join with the valve body 16.

The valve body 16 defines a passageway that extends between an inlet chamber 20 and the outlet chamber 22. The inlet chamber 20 is in communication with the inlet riser tube 18 to receive inflow water. The outlet chamber 22 is in communication with an outlet spout 24, which directs water flow outwardly and downwardly from the valve body 16. As can be seen in FIG. 2, the outlet chamber 22 and the outlet spout 24 form a continuous passage, such that the outlet chamber 22 and outlet spout 24 are distinguished by differing diameters of the flow path. It will be appreciated that in some alternative embodiments the outlet chamber 22 and outlet spout 24 are arranged such that the diameter of the flow path from the valve body 16 to the discharge end of the spout 24 is constant.

The inlet riser tube 18, the passageway within the valve body 16 and the outlet spout 24 define a water flow path that extends between an inlet and an outlet. In this embodiment, the inlet is at the lower end of the inlet riser tube 18, and the outlet is provided by the spout 24.

The valve body 16 defines a valve seat 26 that is located between the inlet and outlet chambers 20, 22. The valve assembly further has a valve plunger 28 that co-operates with the valve seat 26 to open/close the water flow path.

Furthermore, the valve assembly, and thus also the valve seat 26, is located at the top of the water flow path. Thus, water can very readily drain from the water flow path downstream of the valve seat 26 when the plunger 28 is closed onto the valve seat 26. This has the advantage of utilizing gravity forces to minimize the volume of water that remains within the outlet chamber 22 and outlet spout 24 following closure of the valve.

In this embodiment, the valve assembly includes a valve actuator that moves the plunger 28. In addition, in this embodiment, the valve actuator is in the form of a solenoid 30 and biasing spring (not shown). When the coil of the solenoid 30 is charged, the plunger 28 is lifted off the valve seat 26 to allow water to flow through the water flow path. The biasing spring urges the plunger 28 onto the valve seat 26, and thus the valve is arranged to be closed in the neutral state. This ensures that the plunger 28 is seated against the valve seat 26 when the solenoid 30 is uncharged.

In an alternative embodiment (not illustrated), the valve actuator may incorporate a diaphragm that closes onto a valve seat to selectively open/close the water flow path, thus isolating the moving parts of the valve from the water flow path.

In yet another alternative embodiment (not illustrated), the valve actuator may be a rotary type with a ball that has an aperture, in which the ball is encapsulated in a valve seat so that the actuator can rotate the ball between open and closed positions to selectively open/close the water flow path.

A sensor 32, for example an infra-red sensor, is arranged in the casing 14 below the outlet spout 24. The sensor 32 is capable of sensing when a person's hands are within a certain range. The sensor 32 is in electrical communication with the switch 46 of the electronic controller 44. When the sensor 32 senses the presence of a person's hands, the switch 46 associated with the electronic controller 44 causes the valve plunger 28 of solenoid 30 to move so that the water flow path is opened. Thus, a user does not need to physically contact any components of the water discharge device 10 in order to open the valve. In this embodiment, the switch is indirectly operated by the user.

The water discharge device 10 includes a cap 34 that covers the valve actuator and mates with the valve body 16 to provide an aesthetically pleasing appearance.

Figure 5:
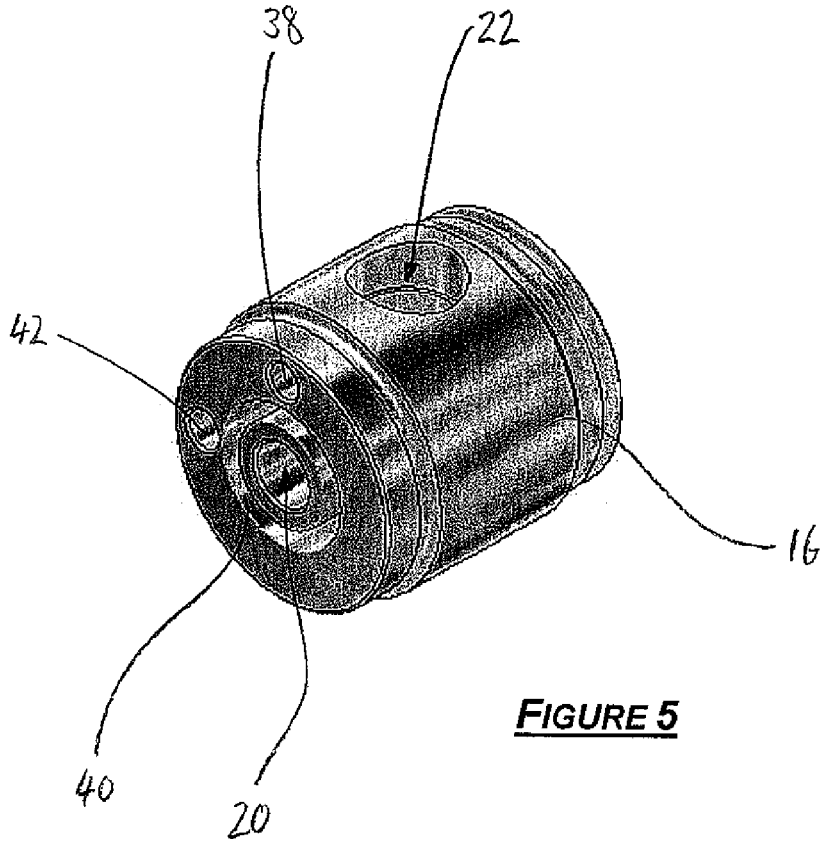
FIG. 5: is a second perspective view of the valve body of the water discharge device of FIG. 1.

A heating element 36 is provided in an aperture 38 in the lower end of the valve body 16. As shown in FIG. 5, the aperture 38 is beside the outlet chamber 22. Thus, heat generated by the heating element 36 is readily conducted through the valve body 16 to maximise heat to the discharge device 10 in the region of the outlet chamber 22 and outlet spout 24. As can be seen in FIG. 2, the heating element 36 is isolated from the flow path. In this way, water passing through the flow path does not directly contact the heating element 36.

Figure 4:
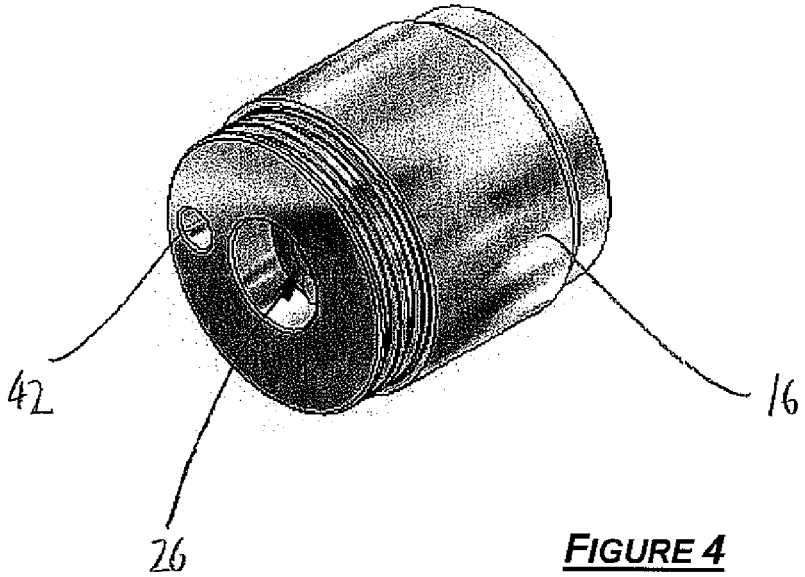
FIG. 4: is a first perspective view of the valve body of the water discharge device of FIG. 1.

A void, which in this embodiment is in the form of an annular recess 40, is formed between the aperture 38 and the inlet chamber 20. The void minimizes conductive heat transfer from the heating element 36 to the inlet chamber 20 and also the inlet riser tube 18. As shown in FIGS. 2 and 4, the annular recess 40 extends around the inlet chamber 20. Accordingly, the annular recess 40 aids conductive heat transfer towards the outlet chamber 22 and also towards the outlet spout 24.

A through hole 42 extends through the valve body 16 parallel with the inlet chamber 20. The through hole 42 provides a passage through which electrical wires 39 pass in order to have the controller 44 in electrical communication with the solenoid 30, the sensor 32 and the heating element 36.

The switch 46 associated with the electronic controller 44 can operate the solenoid 30 and heating element 36 according to a predetermined sequence in response to the sensor 32 providing a signal indicative of a sensed action. This will be discussed in further detail in connection with FIGS. 9 to 11.

Electrical wires 39 for the solenoid 30 and/or heating element 36 that pass through the base 12 and casing 14 can be provided with insulation that thermally as well as electrically insulates the wires. In this way, heat transfer from the heating element 36 to the wires is minimized.

In certain embodiments, the heating element 36 can be activated for a predetermined period of time following a change of state of the valve. Thus, the heating element can heat the outlet chamber 22 and outlet spout 24 to evaporate moisture from internal surfaces outlet chamber 22 and outlet spout 24 following discharge of water from the device 10.

The throughway defined by the base 12 and casing 14 together a through which an inlet riser tube 18 can pass from below the bench top T to join with the valve body 16.

The inlet riser tube 18 of the water discharge device 10 of this embodiment can be connected to a water tempering device (not shown) that mixes hot and cold water from separate distribution lines. Thus, water can be delivered to the inlet riser tube 18 at a desired temperature. This tempering device can be manually set to give a fixed water temperature, or controlled in response to the distance the hand is moved towards the sensor 32, or the position of the hand relative to the sensor 32. Alternatively, the inlet riser tube 18 of the water discharge device 10 can be connected to a single water distribution line, which can be either hot or cold water.

The heating element 36 can be operated at a selected temperature and for a selected period of time to establish a dry, biostatic environment in the outlet chamber 22 and outlet spout 24. As will be appreciated, the selected temperature and period of time will be determined by the structure of the discharge device.

In certain embodiments, the heating element 36 is capable of raising the temperature of the internal surfaces of the outlet chamber 22 and outlet spout 24 to sanitisation temperatures of at least 121° C.

Figure 6:
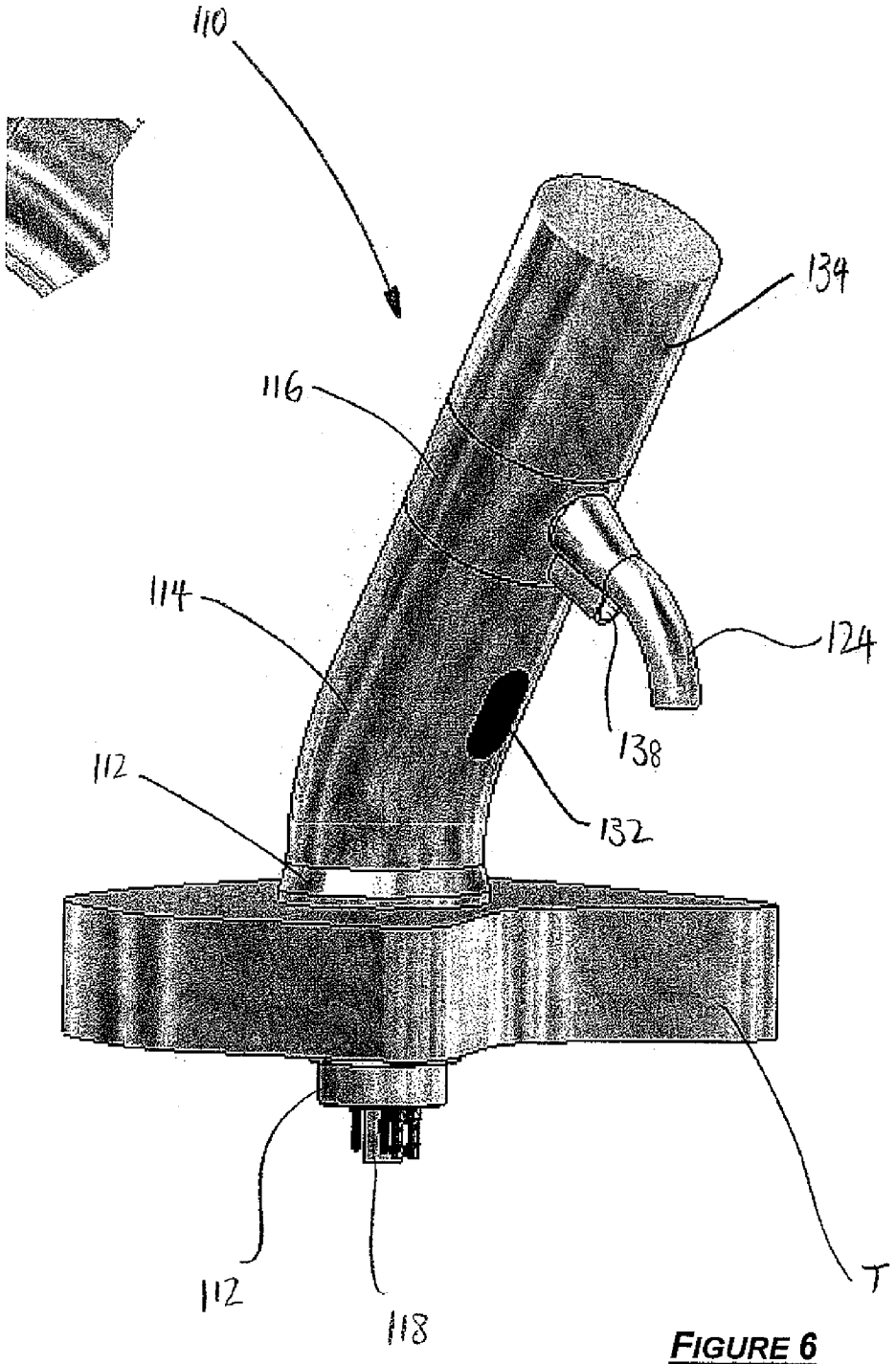
FIG. 6: is a perspective view of a water discharge device according to a second embodiment of the present invention.
Figure 7:
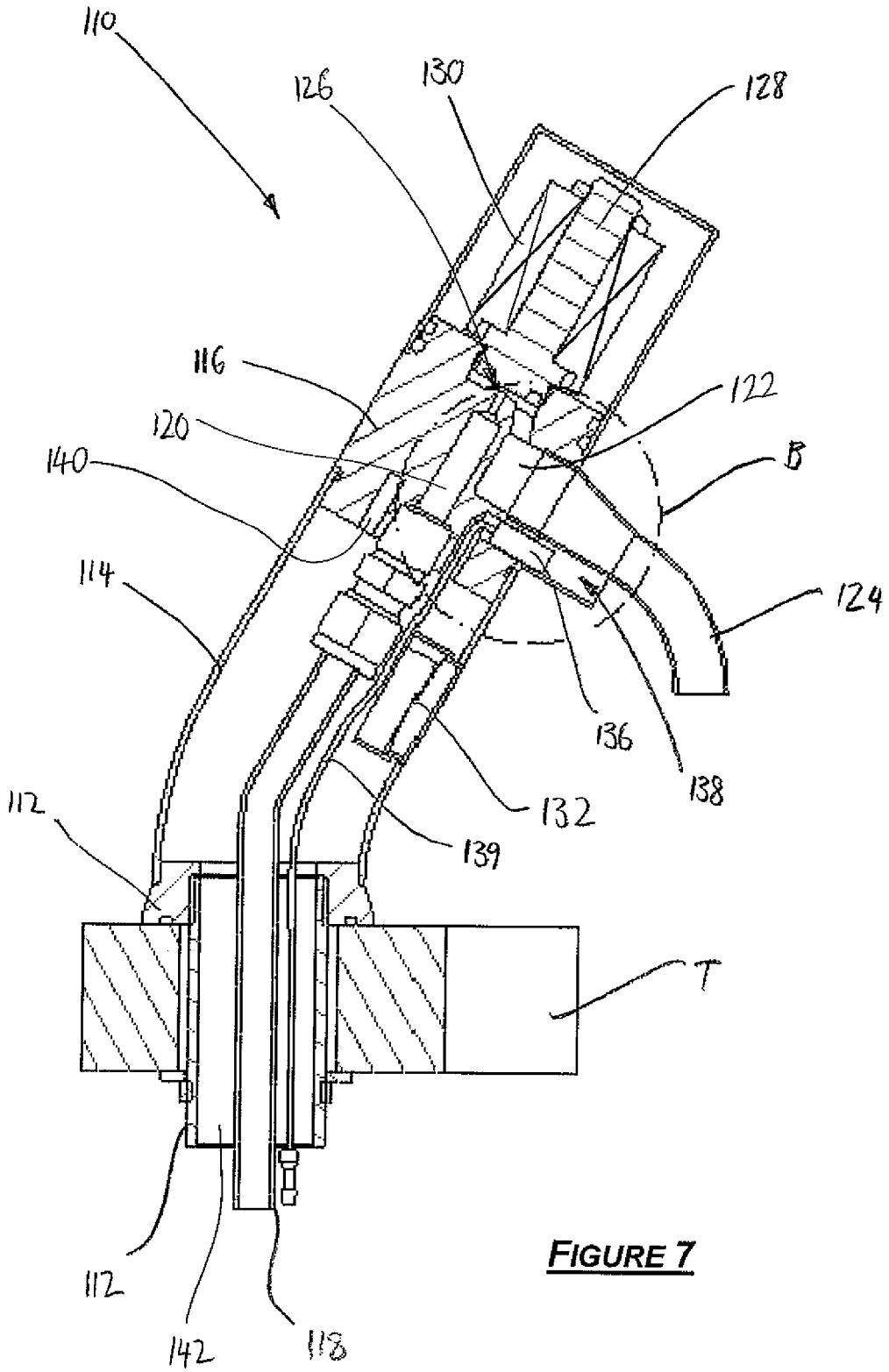
FIG. 7: is a vertical cross section view of the water discharge device of FIG. 6.
Figure 8:
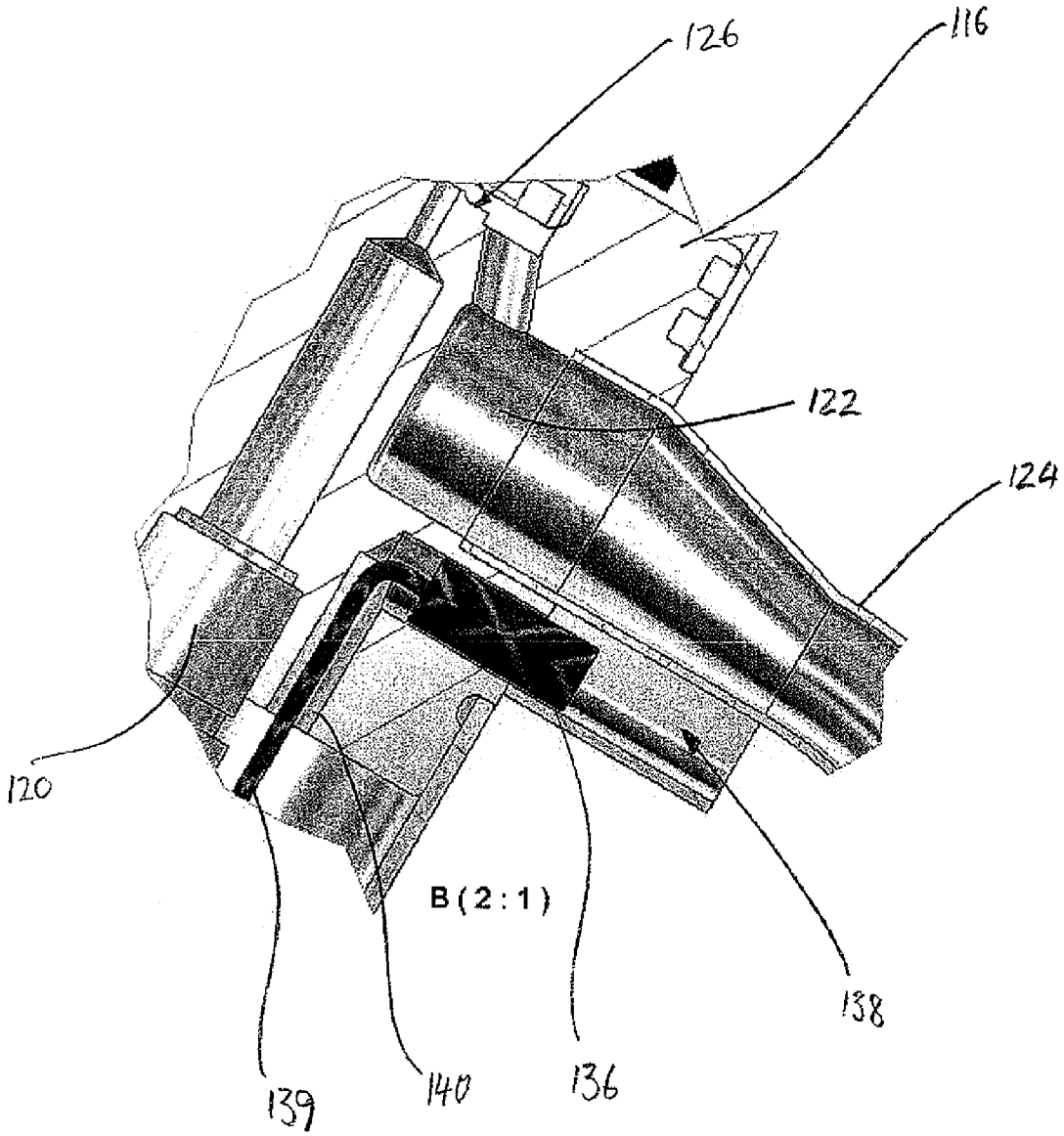
FIG. 8: is an enlarged view of the region marked B in FIG. 7.

FIGS. 6 to 8 show a water discharge device 110 according to a second embodiment of the present invention. Features of the water discharge device 110 that correspond with features of the water discharge device 10 are given the corresponding reference numerals incremented by 100.

Compared with the water discharge device 10, one significant difference of the water discharge device 110 is that the casing 114 includes a bend of approximately 30°. The inlet riser tube 118 also includes a bend of the same angle. Thus, the outlet spout 124 is projected outwardly to be further over the sink/basin compared with that of the water discharge device 10. However, as can be seen from FIGS. 7 and 8, the valve seat 126 is located at the top of the water flow path. Thus, water can very readily drain from the water flow path downstream of the valve seat 126 when the plunger 128 is closed onto the valve seat 126.

Compared with the water discharge device 10, another significant difference of the water discharge device 110 is that the aperture 138 within which the heating element 136 is positioned is parallel with the outlet chamber 122, and is in connection with the annular recess 140. Thus, the heating element 136 is in close proximity to the outlet chamber 122, and also outlet spout 124. Heat generated by the heating element 136 may more quickly conduct to the outlet chamber 122 and outlet spout 124.

The electrical wires 139 of the heating element 136 pass from the aperture 138 into the annular recess 140 and into the hollow of the casing 114.

Figure 9:
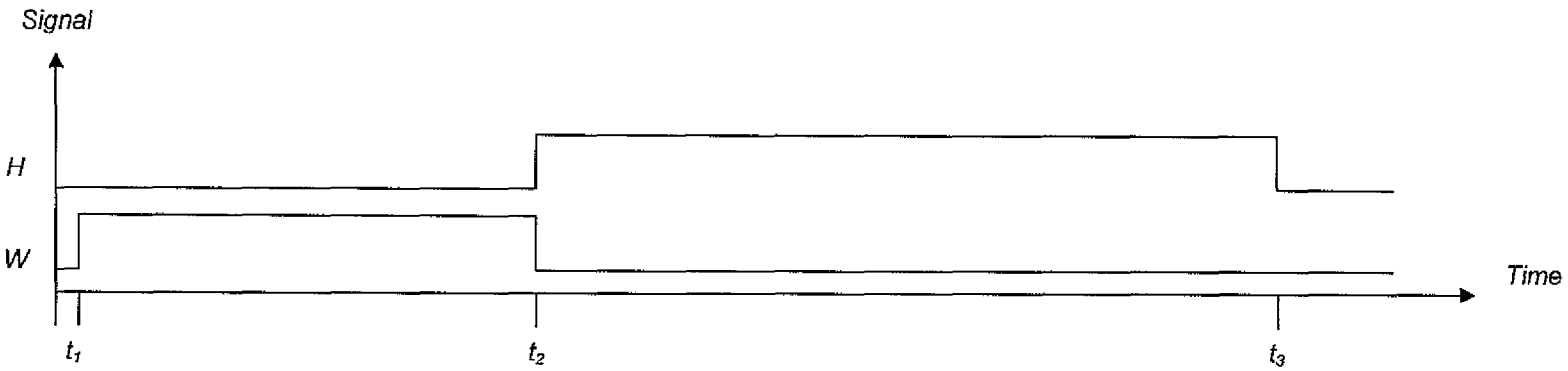
FIG. 9: is a first schematic timing diagram illustrating operation of a water discharge device according to embodiments of the present invention.
Figure 10:
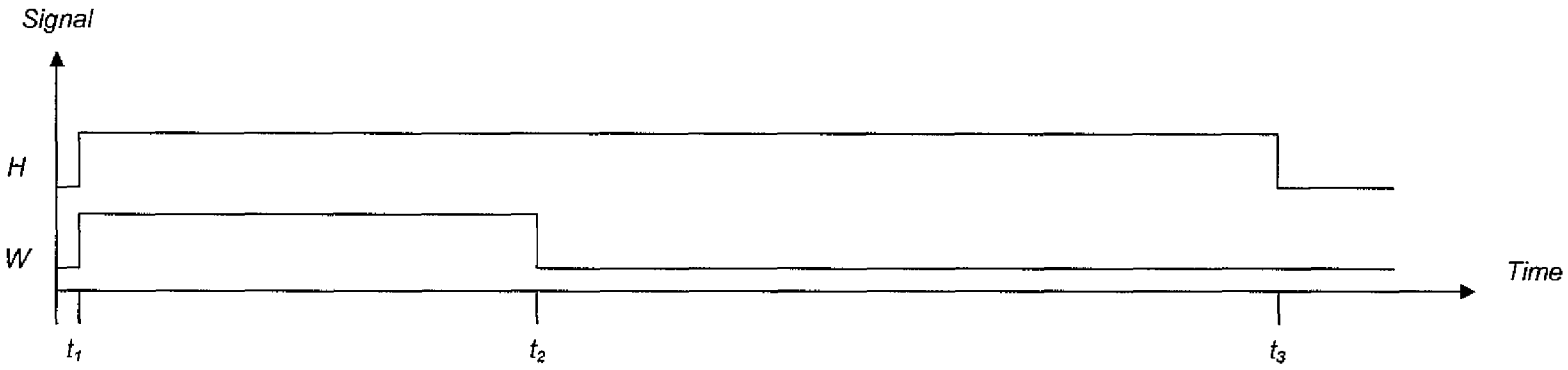
FIG. 10: is a second schematic timing diagram illustrating operation of a water discharge device according to embodiments of the present invention.
Figure 11:
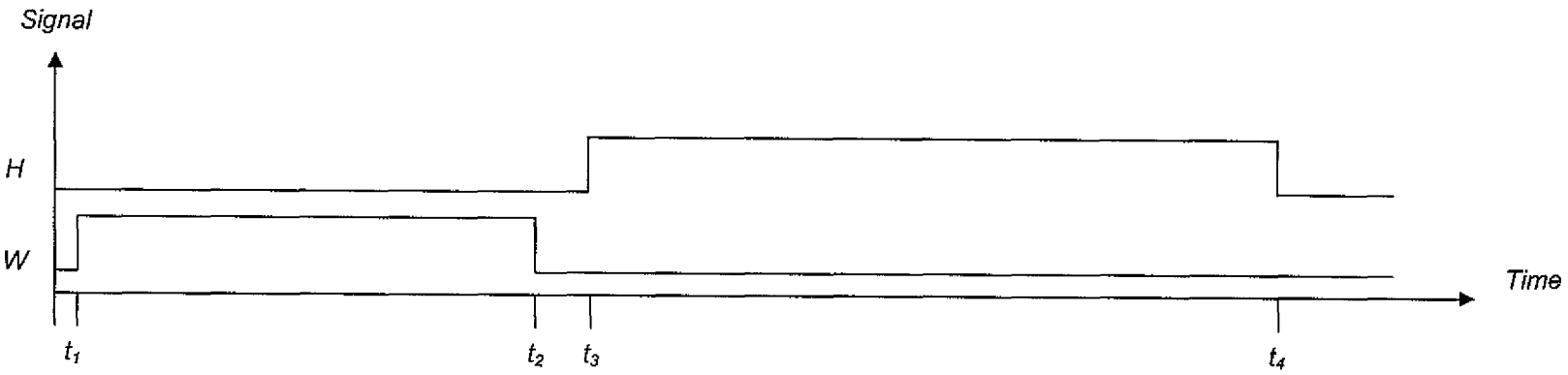
FIG. 11: is a third schematic timing diagram illustrating operation of a water discharge device according to embodiments of the present invention.

Each of FIGS. 9 to 11 show schematically a timing diagram for operation of a water discharge device according to embodiments of the present invention, e.g. the embodiments shown in FIGS. 1 to 5, or FIGS. 6 to 8. In these diagrams, time is shown on the horizontal axis, and the vertical axis shows the signal state W for the valve actuator and the signal state H for the heating element.

In the timing diagram shown in FIG. 9, the sensor of the water discharge device provides a signal (not shown) that may be indicative of the presence of a person's hand. The sensor signal is provided at time $t_1$, at which time the signal state W for the valve actuator is changed to active, which causes the valve to open. The signal state W remains active until time $t_2$, at which time it returns to neutral. Therefore, the valve actuator holds the valve open for a first period of time ($t_2$–$t_1$).

At time $t_2$, the signal state H for the heating element is changed to active, which causes the heating element to generate heat. The signal state H remains active until time $t_3$, at which time it returns to neutral. Therefore, the heating element is activated for a predetermined second period of time ($t_3$–$t_2$). In the timing diagram shown in FIG. 9, the second period of time commences immediately at the conclusion of the first period of time. The second period of time concludes after the conclusion of the first period of time. Thus, heat is generated by the heating element, and transferred to the outlet chamber, for some time after water ceases to flow from the discharge device.

In the timing diagram shown in FIG. 10, the sensor of the water discharge device provides a signal (also not shown) at time $t_1$, at which time the signal state W for the valve actuator is changed to active, which causes the valve to open. The signal state W causes the valve actuator to hold the valve open for a first period of time, which concludes at time $t_2$. Therefore, in this timing diagram the first period of time is $t_2$–$t_1$.

Also at time $t_1$, the signal state H for the heating element is changed to active, which causes the heating element to generate heat. The signal state H remains active until time $t_3$, at which time it returns to neutral. Therefore, the heating element is activated for a predetermined second period of time ($t_3$–$t_1$). In the timing diagram shown in FIG. 10, the second period of time overlaps the first period of time. The second period of time concludes after the conclusion of the first period of time. The overlap enables the heating element to start generating heat before water ceases to flow from the discharge device.

In the timing diagram shown in FIG. 11, the sensor of the water discharge device provides a signal (also not shown) at time $t_1$. The signal state W is active for a first period of time, which concludes at time $t_2$. Therefore, in this timing diagram the first period of time is $t_2$–$t_1$.

The signal state H is active for a predetermined second period of time, commencing at time $t_3$ and concluding at time $t_4$. Therefore, the heating element is activated for a predetermined second period of time ($t_4$–$t_3$). In the timing diagram shown in FIG. 10, the second period of time is separated from the first period of time. The second period of time concludes after the conclusion of the first period of time.

It will be also appreciated that the water discharge device of certain embodiments of the present invention may be operated such that the first period of time is a predetermined length of time. Alternatively, in some other embodiments, the first period of time may be flexible and determined by the sensor providing a signal indicative of the presence of a person's hand.

It will be also appreciated that the water discharge device of embodiments of the present invention may be operated according to other timing diagrams. For instance the first and second periods of time may overlap, with the second period of time commencing after the first period of time commences.

In some alternative embodiments, the switch may be positioned remotely from the electronic controller and/or may be operated directly by the user. For example, an switch may be located in the floor near the discharge device. In this example, the user depresses the switch with their foot to cause the electronic controller to open the water flow path.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be understood to persons skilled in the art of the invention that many modifications may be made without departing from the spirit and scope of the invention.

The invention claimed is:

1. A water discharge device comprising:

a valve body that defines a water flow path extending from an inlet to an outlet spout, an inlet chamber in which a valve seat and a valve plunger that co-operates with the valve seat is located, and a valve plunger that co-operates with the valve seat and is movable by a valve actuator to open and close the flow path;

a valve assembly for opening and closing the water flow path, the assembly being located at a top of the flow path so that, when the flow path is closed by the valve assembly, water downstream of the valve assembly drains from the flow path, the valve assembly including the valve actuator; a heating element for heating an outlet chamber and the outlet spout to evaporate moisture on internal surfaces of the outlet chamber and spout when the flow path is closed by the valve assembly, the heating element being remote from the flow path; and a controller for controlling operation of the valve actuator, the controller including a switch that is operated directly or indirectly by a user to control the opening of the water flow path;

wherein the valve body includes a void that extends around the inlet chamber for minimizing conductive heat transfer from the heating element to the inlet chamber.

2. A water discharge device comprising:

a valve body that defines a water flow path that extends from an inlet to an outlet forming an inlet chamber there between; a valve seat and a valve plunger that co-operates with the valve seat and is movable by the valve actuator to open and close the flow path between the inlet and outlet;

a heating element that is remote from the flow path, the heating element being arranged to heat the device to evaporate moisture on internal surfaces surrounding the flow path between the valve assembly and the outlet when the flow path is closed by the valve assembly; and a controller for controlling operation of the valve assembly, the controller including a switch that is operated directly or indirectly by a user to control opening and closing of the water flow path;

wherein the valve body includes a void that extends around the inlet chamber for minimizing conductive heat transfer from the heating element to the inlet chamber.

3. A water discharge device according to claim 2, wherein the outlet comprises an outlet chamber and an outlet spout.

4. A water discharge device comprising:

a water flow path that extends from an inlet through an outlet chamber to an outlet spout;

a valve assembly for opening and closing the water flow path; the valve assembly including a valve actuator; a valve body that defines a valve seat and a valve plunger that co-operates with the valve seat and is movable by the valve actuator to open and close the flow path;

a heating element for heating the outlet chamber and spout to evaporate moisture on internal surfaces of the outlet chamber and spout when the flow path is closed by the valve assembly, the heating element being remote from the flow path; and a controller for controlling operation of the valve assembly and the heating element, the controller including a switch that is operated directly or indirectly by a user to control the opening of the water flow path;

wherein the valve body has an inlet chamber that forms part of the flow path; wherein the valve seat and valve plunger are positioned between the inlet and outlet chambers; and wherein the valve body includes an aperture within which the heating element is disposed, the aperture being beside the outlet chamber, to maximize conductive heat transfer to the outlet chamber and outlet spout, the valve body includes a void in the form of an annular recess that extends around the inlet chamber for minimizing conductive heat transfer from the heating element to the inlet chamber.

5. A water discharge device according to claim 4, wherein water passing through the flow path does not directly contact the heating element.

6. A water discharge device according to claim 4, wherein the valve assembly is located at a top of the flow path so that, when the flow path is closed, water downstream of the valve assembly drains from the flow path.

7. A water discharge device according to claim 4, further comprising a sensor that is in electrical communication with the switch, wherein the sensor can sense when a person's hands are within a certain range and cause the controller to open and close the water flow path.

8. A water discharge device according to claim 7, wherein the sensor is an infra-red sensor.

9. A water discharge device according to claim 4, further comprising a base for mounting the device to a bench top and a casing that supports the valve body above the base.

10. A water discharge device according to claim 9, wherein the base defines a throughway and the casing is hollow such that electrical wires and an inlet riser tube can pass through the base and the casing.

11. A method of operating a water discharge device according to claim 4, the method comprising: opening the valve assembly for a first period of time to allow water to flow through the flow path, and operating the heating element for a second period of time, wherein the second period of time concludes after the first period of time.

12. A method according to claim 11, wherein the first and second periods of time overlap.

13. A method according to claim 11, wherein the first and second periods of time commence concurrently.

14. A method according to claim 11, wherein the second period of time is a predetermined period of time.

15. A method according to claim 11, wherein the first period of time is a predetermined length of time.

* * * * *